US006130611A

United States Patent [19]

Pellaton et al.

[11] Patent Number: 6,130,611

[45] Date of Patent: Oct. 10, 2000

[54] LOCKING SYSTEM FOR ENTRY DOOR TO A SECURITY ENCLOSURE, ABLE TO CONTROL THE DEVELOPMENT OF A PARAMETER LINKED TO THE ENVIRONMENT OF THE ENCLOSURE

[75] Inventors: Pierre Pellaton, Le Locle; Didier Dominé , La Chaux-de-Fonds, both of Switzerland

[73] Assignee: Ilco-Unican S.A./Rehlor Division, Le Locle, Switzerland

[21] Appl. No.: 09/172,014

[22] Filed: Oct. 14, 1998

[30] Foreign Application Priority Data

Oct. 14, 1997 [EP] European Pat. Off. ..... 97117767

[51] Int. Cl.[7] ..... E05B 45/06

[52] U.S. Cl. ..... 340/542; 340/541; 340/540

[58] Field of Search ..... 340/542, 543, 340/541, 540, 517, 521, 825.31; 70/280

[56] References Cited

U.S. PATENT DOCUMENTS

| | | | |
|---|---|---|---|
| 5,479,151 | 12/1995 | Lavelle et al. | 340/542 |
| 5,479,341 | 12/1995 | Pihl et al. | 340/542 |
| 5,670,940 | 9/1997 | Holcomb et al. | 340/543 |
| 5,942,973 | 8/1999 | Lee | 340/542 |

FOREIGN PATENT DOCUMENTS

| | | |
|---|---|---|
| 0 686 744 A2 | 12/1995 | European Pat. Off. . |
| 2 549 519 | 1/1985 | France . |
| 2 694 650 | 2/1994 | France . |
| 44 38 168 A1 | 5/1995 | Germany . |

*Primary Examiner*—Jeffery A. Hofsass
*Assistant Examiner*—Sihung Huang
*Attorney, Agent, or Firm*—Griffin & Szipl, P.C.

[57] ABSTRACT

The present invention concerns a locking system (31) for an entry door to a security enclosure arranged in an environment. This locking system includes a mechanism (33) able to command, in response to an instruction, the locking or unlocking of the entry door, storage means (43) able to contain reference data (X3) relating to a parameter (X) linked to the environment, and depending on the environment, and a processing unit (37) able to receive the reference data and parameter measurement data (X2) and, in response, to supply the command instruction. This arrangement gives the locking system autonomous control of the development of a parameter and centralised control of the locking and/or unlocking. The storage means (43) can be arranged to give the locking system the faculty of ≪intelligent≫ interpretation of the events and phenomena occuring during its daily operation.

15 Claims, 9 Drawing Sheets

LOCKING SYSTEM FOR ENTRY DOOR TO A SECURITY ENCLOSURE, ABLE TO CONTROL THE DEVELOPMENT OF A PARAMETER LINKED TO THE ENVIRONMENT OF THE ENCLOSURE

The present invention concerns the field of locks for entry doors intended to be fitted to security enclosures such as safes and strong rooms. More particularly, the invention concerns a locking system for an entry door fitted to a security enclosure, such locking system being able to control the development of a parameter linked to the environment of said enclosure.

In light of the increasing sophistication of assaults on security enclosures, in order to protect such enclosures one seeks to be able to detect anomalous situations caused by disturbances of an increasingly diversified nature.

An entry door to an enclosure of a safe or strong room conventionally includes a boltwork assembly, i.e. an assembly formed of boltworks and bars forming a control system able to lock or unlock the entry door. Generally, this door also includes a locking system provided with a bolt, such bolt being able, on demand, to release or lock the boltwork assembly, so that, when the boltwork assembly is actuated to achieve locking or unlocking of the entry door, such locking or unlocking is permitted or not permitted.

Generally, there exist three types of protective devices suitable for protecting enclosures against break-in attempts.

The first type of protective device which is commonly used in the field of safes and strong rooms is usually called a ≪sensor≫.

FIG. 1 shows an enclosure 1 of a safe 3 fitted with three sensors 5 to 7 connected to an alarm system (not shown). Sensors 5 and 6 are placed respectively on walls 9 and 10 of enclosure 1, and sensor 7 is placed on an entry door 12 of safe 3. Such sensors are arranged to be able to measure a parameter linked to the enclosure, for example a vibration or a temperature increase, and to be able to transmit in response a signal able to trigger, via the alarm system, an alarm signal, for example a telephone call.

Let us consider the case in which sensors 5 to 7 are arranged to detect a vibration propagating over one of walls 9 or 10, and over door 12. Let us also consider the case in which door 12 is the subject of a break-in attempt, and that this attempt causes the propagating of a vibration over the door. The equipment described in relation to FIG. 1 then allows the existence of an anomalous situation in the environment of the enclosure to be indicated from a distance.

Within the alarm system field, there exist a good number of sensors whose operation is close to that described in relation to FIG. 1.

French Patent No. 2,694,650 discloses a system including a sensor able to detect the waves derived from displacements of air mass due to the opening of a door or a window in an enclosed space. This system can receive the signal from the sensor, compare this signal to stored signals and, in the event that these signals are recognised, provide a control signal for an alarm corresponding to the opening of the door or window.

One drawback of such sensors lies in the fact that, in the event of a break-in attempt, the sensor is not capable of causing the door to lock.

Another drawback of such sensors lies in the fact that the operation thereof is independent of the phenomena occurring in the environment of the enclosure, such as a temperature increase linked to an expected seasonal climatic phenomenon.

Another drawback of the sensor of FIG. 1 lies in the fact that it has to be placed on one of the walls of the enclosure, which makes the sensor visible from the exterior, so that it can become the subject of unauthorised manipulations.

The second type of protective device is commonly called a relocker.

FIG. 2A shows a rear face view of an entry door 18 allowing access to a safe such as that shown in FIG. 1, one panel of such door having been removed to allow the internal structure of the door to be seen.

Door 18 is conventionally fitted with locks 20, a boltwork assembly 22 and a relocker 24 the operation of which will be described hereinafter. Relocker 24 includes a mechanism 26 capable of immobilising boltwork assembly 22, this mechanism being independent of locking system 20. Relocker 24 further includes a retention device 28 able to hold this mechanism in a position called the retention position. In the example shown in FIG. 2A, mechanism 26 is formed of two bolts 29 which are arranged to be able to immobilise boltwork assembly 22, so that, when one then wishes to actuate boltwork assembly 22 to achieve unlocking of the entry door, such unlocking is now longer permitted, like the locking caused by the bolt of this door. Retention device 28 can be formed of a sheet of glass connected to bolts and prestressed springs, these components being arranged so that the relocker is held in a prestressed position, or retention position.

Existing relockers are essentially heat relockers able to be release following an anomalous development in the ambient temperature of the environment in which such relockers are arranged. There also exist shock relockers able to be release following a shock applied onto the wall protected by such a relocker.

FIG. 2B illustrates the operation of relocker 24, in the event that door 18 is the subject of a break-in attempt.

As FIG. 2B shows, this break-in attempt has the effect of releasing retention device 28 with respect to its retention position, and activating relocker 24. The different components, and in particular bolts 29, which were initially prestressed are moved into a position in which they immobilise boltwork assembly 22. Consequently, door 18 remains in a locking position, which prevents anyone from opening the safe. In other words, the break-in attempt is unsuccessful.

Within the general field of locking systems, there also exist relockers whose operation is close to that described in relation to FIGS. 2A and 2B.

European Patent No. 0,686,744 discloses a locking system for preventing the opening of a door to an enclosed space where the atmosphere can be harmful to man. This system can detect the concentration of oxygen in the enclosed space, and provide a signal proportional to such concentration. If the latter is comprised within a determined range, the system can command the locking of the entry door.

One drawback of such relockers lies in the fact that they do not perform an analysis of the nature of the phenomenon which triggered the detected anomalous situation, and they command the locking or unlocking of the door, following detection of the effects of the phenomenon, and not the causes which may have induced the phenomenon. Typically, their operation is independent of phenomena occurring in the environment of the enclosure, for example an increase in temperature linked to a seasonal climatic phenomenon naturally occurring in such environment. Thus, following such a temperature increase, said relockers perform unnecessary locking or unlocking of the door, given that the phenomenon detected derives from natural forces.

Moreover, within the particular field of safes and strong rooms, a major drawback of the relocker of the type of those of FIGS. 2A and 2B lies in the fact that, when locked, the entry door requires destructive intervention to allow access to the enclosure again, and to bring the different components of the relocker back into their initial retention position. This intervention involves high repair costs.

Another drawback of these relockers lies in the fact that they can be released accidentally, for example by the effect of an anodyne shock to the entry door, without any break-in attempt having actually been made. This type of inadvertent releasing of the door nonetheless requires destructive intervention on the door and, consequently high repair cost. This is all the more detrimmental since the relockers of certain bank safe enclosures are arranged to command, in the event of a detected break-in, a system which marks the banknotes contained in the enclosure.

The third type of known protective device has the objective of neutralising an aggressor, when he attempts to break into the enclosure. Typically, such a device can release a toxic gas, an electric charge or a jet flame. Generally, the installation of such devices is prohibited by law.

Moreover, the Applicant of the present invention has observed that a good number of the security enclosure protective devices only belatedly provide indication of a break-in to such enclosure, i.e. after the break-in has succeeded, often following several hours of work on the enclosure. For example, the break-in can be: an explosion of the enclosure following a massive injection of an explosive gas into the environment of the enclosure; or tearing open of the enclosure following repeated hammering.

An object of the present invention is to provide a locking system overcoming the aforementioned drawbacks and, more precisely, a locking system for an entry door to a security enclosure, such locking system being able to control the development of a parameter derived from a phenomenon occurring in the environment of the enclosure.

Another object of the present invention is to provide a locking system able to determine the nature of the phenomenon which triggers an anomalous development in the detected parameter and, in response to such determination, the command the locking or unlocking of the entry door.

Another object of the present invention is to provide a locking system able to be adapted to parameter developments linked to the environment of the enclosure, so as to avoid locking or unlocking of the entry door, following an anomalous development in the parameter, caused by a normal activity in the environment of the enclosure.

Another object of the present invention is to provide a locking system answering the usual concerns as to effectiveness and cost.

These objects, in addition to others, are achieved by the locking system according to claim 1.

The invention concerns a security enclosure entry door locking system arranged in an environment. This locking system includes a mechanism able to command, in response to an instruction, the locking and/or unlocking of said door, storage means able to contain reference data relating to a parameter linked to said environment, in particular predetermined thresholds depending on said environment, and/or the physical arrangement of said enclosure, and/or the daily activity inside said environment. This locking system further includes a processing unit able to receive measurement data for said parameter provided by a transducer, and said reference data, to determine whether it is normal for the phenomenon which triggered an anomalous development in said parameter to have occurred and, as a function of the result of such determination, to provide said command instruction to said mechanism.

One advantage of such an arrangement is that the locking system can itself perform the locking and/or unlocking command, from parameter measurement values, and the processing thereof, which achieves centralised control of such command, and gives the locking system autonomy of control of the development of the parameter. In other words, the locking system according to the present invention corresponds to a new type of protective device against break-in attempts on the enclosure, allowing an anomalous development of a parameter linked to the environment to be detected, such development to be analysed, and the locking and/or unlocking of the entry door to be commanded in response.

Another advantage of such an arrangement is that, once locked by the locking system, the entry door does not require destructive intervention to be able to provide access to the enclosure again, unlike the conventional relockers described hereinbefore in relation to FIGS. 2A and 2B. Indeed, the entry door can be unlocked by an instruction provided by a specific code, such instruction being provided from the exterior, for example via a connection to a portable processing unit.

Another advantage of such an arrangement is that the locking system can cause locking and/or unlocking of the entry door, without using an additional connection to the boltwork assembly of the door.

One advantage of being able to contain such reference data is that it allows a programmer to adapt the locking system to the environment of the enclosure, so as to avoid unecessary locking or unlocking of the entry door, following an anomalous development in the measured parameter, caused by a normal activity inside the environment of the enclosure or by a local climatic phenomenon.

Another advantage linked to such reference data is that it is possible to command the locking and/or unlocking of the door, as a function of the predetermined threshold, so that this command can occur at the first signs of the break-in. In other words, such a locking system can advantageously provide a preventative command, from the detection of the first steps of an anomalous development in the parameter.

According to another feature, the processing unit of the locking system according to the present invention is arranged to perform, amongst a plurality of signatures, identification of the signature which corresponds to the data relating to the measurement of the parameter, which has the advantage of determining the nature of a phenomenon which triggered an anomalous development in the parameter, before deciding whether the entry door should be locked or unlocked. This allows, in particular, accidental actuation of the entry door locking to be avoided, for example by the effect of an anodyne shock, without any break-in attempt actually occurring.

According to another feature, the storage means of the locking system according to the present invention can receive and contain data relating to the parameter measurement, so as to update a diary of events tracing the history of the locking system, which has the advantage of providing a follow-up for the parameter measurement values, i.e. allowing a posteriori analysis of the events in the history of the locking system, in particular those relating to any break-ins.

Another advantage linked to the arrangement of such storage means is that it guarantees the survival of data contained in the diary of events (Audit trail), since this latter is contained in the locking system itself.

Another advantage linked to the arrangement of such storage means is that the data relating to the parameter measurement can be used as signatures, which has the advantage of allowing the locking system to adapt itself to the environment of the enclosure.

According to another feature, the locking system according to the present invention incorporates the transducer, which has the advantage of reinforcing the autonomy of the locking system. Indeed, this latter thus includes a restricted number of components which, arranged in a monolithic manner, perform the locking and unlocking functions for the entry door, and that of controlling the development of the parameter, which answers the usual concerns as to effectiveness and cost.

Another advantage linked to the incorporation of the transducer in the locking system is that it guarantees the discretion and camouflage of the protective device formed by the locking system, in particular the fact that the transducer is no longer visible from the exterior of the enclosure.

According to another feature, the locking system according to the present invention can include a communication interface connected to the processing unit, which has the advantage of allowing a user outside the enclosure to monitor such enclosure from a distance, without the necessity of placing a video camera in proximity to the enclosure, such camera being difficult to install and expensive. Indeed, the user can have knowledge from a distance of an anomalous development in the measured parameter and, thus, anticipate the future development of such parameter, in order to determine whether such development derives from a phenomenon of an unintentional nature (for example a seasonal increase in temperature) or of a deliberate nature (for example a break-in attempt made on the enclosure). In other words, the locking system according to the invention can provide indication to the user at the first signs of a break-in to the enclosure, which also allows untimely locking or unlocking of the entry door to be avoided.

Another advantage linked to the arrangement of such a communication interface is that a follow-up of the parameter measurement values is obtained by remote control, such values being able to be stored in a diary of events (Audit trail) which is off-set with respect to the enclosure. This diary can be analysed a posteriori in order to identify the author or authors of a break-in attempt.

These objects, features and advantages of the present invention, in addition to others, will appear more clearly upon reading the detailed description of two preferred embodiments of the invention, given solely by way of example in relation to the annexed drawings, in which:

FIG. 1, already cited, shows a safe enclosure fitted with conventional sensors;

FIG. 2A, already cited, shows a back face view of a safe door fitted with a conventional relocker;

FIG. 2B, already cited, illustrates the operation of the door relocker of FIG. 2A, following a break-in attempt;

FIG. 3A shows a block diagram of a first embodiment of a locking system according to the present invention, designated by the reference 31.

Figure 1:
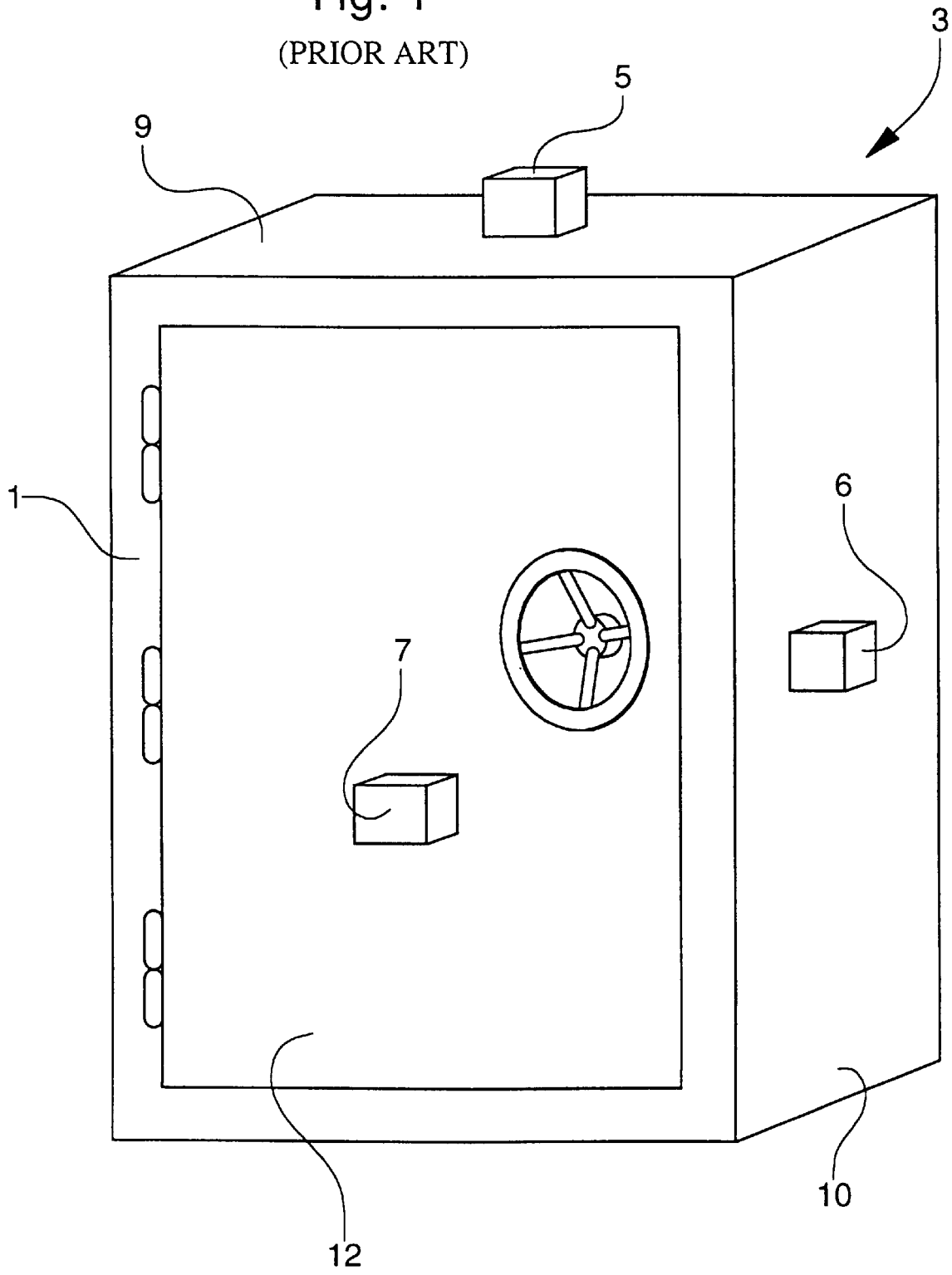
Fig. 1 (PRIOR ART)
Figure 2A:
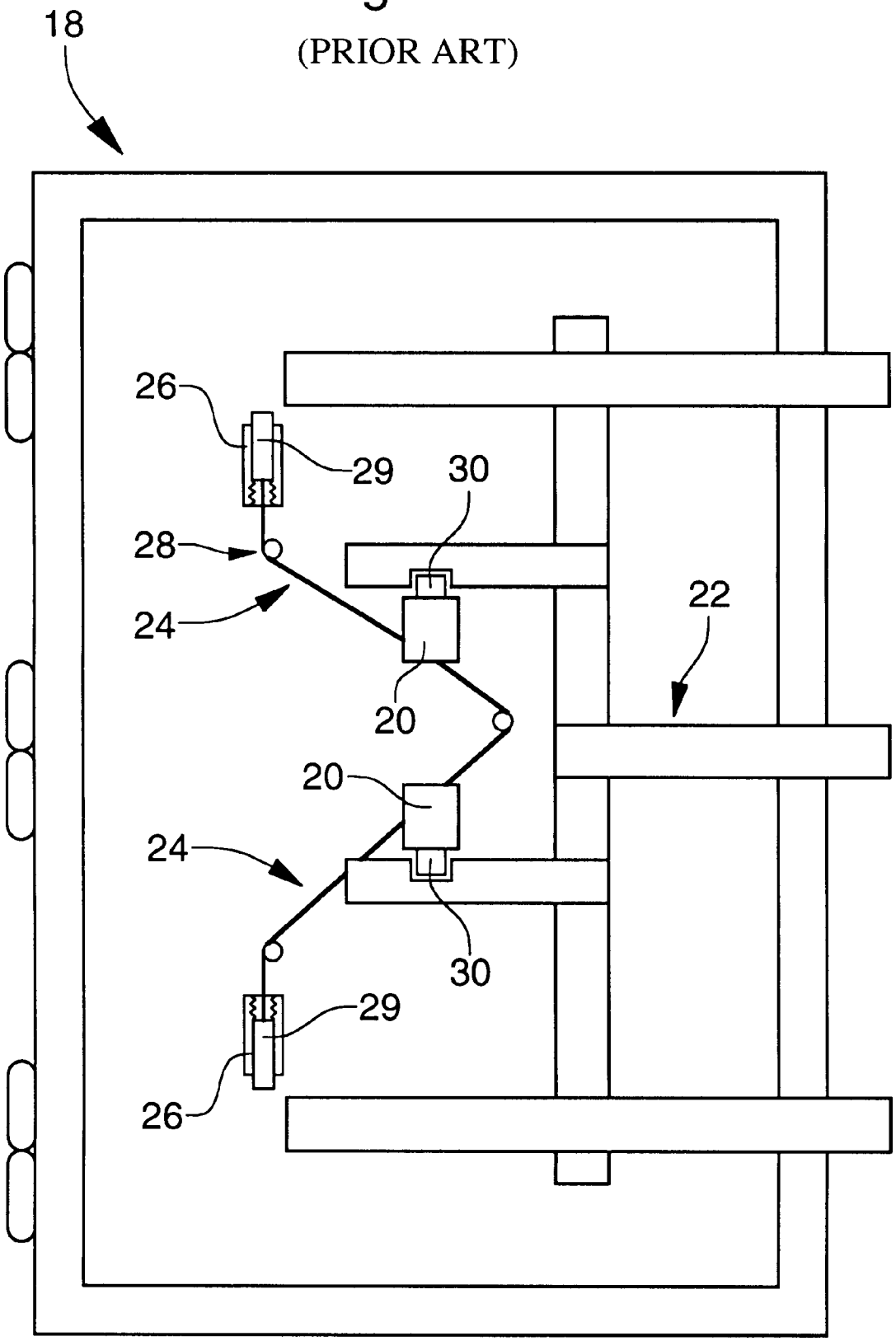
Fig. 2A (PRIOR ART)
Figure 2B:
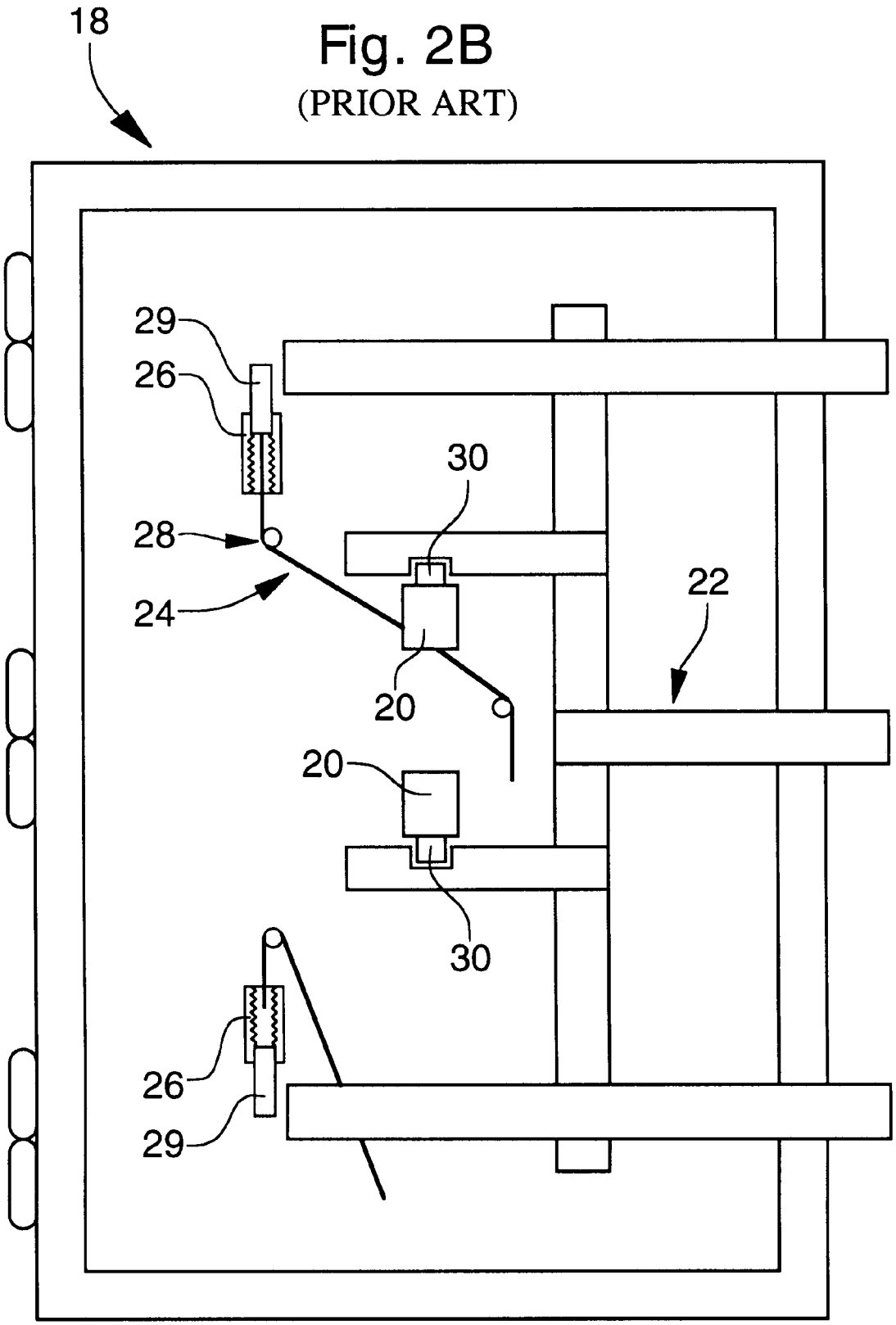
Fig. 2B (PRIOR ART)

Locking system 31 is intended to be fitted to an entry door to a security enclosure (not shown in FIG. 3A) disposed in an environment. This locking system includes a mechanism 33 able to command, in response to a command instruction, locking and/or unlocking of said entry door. Preferably, the security enclosure and entry door are conventionally made,like those shown in FIGS. 1, 2A and 2B. The bolt of locking system 31 of the entry door is used as mechanism 33. The command instruction can thus also order the blocking or release of the entry door boltwork assembly.

With reference again to FIG. 3A, it will be noted that locking system 31 also includes a processing unit 37 connected to mechanism 33 and able to control a change of state of the locking system 31 (i.e. locking or unlocking of the entry door), and to guarantee the current state. Preferably, the component marketed under the name of ≪H83834≫ by the Hitachi company is used as processing unit 37, this component being arranged and programmed as described in more detail hereinafter.

Processing unit 37 is connected to a transducer 35 arranged to provide measurement values X0 of a parameter X linked to the environment of the enclosure, this parameter being able to develop following a phenomenon occurring in the environment of the enclosure.

By way of example of parameter X, in the present case of an enclosure provided with metal walls, parameter X can be the ambient temperature outside or inside the enclosure, this temperature being able to be thermally conducted by such walls. For this purpose, transducer 35 used in locking system 31 includes an ohmic resistor the resistance of which varyies as a function of the temperature, such a resistor being known to those skilled in the art. In the preferred case where the entry door is fitted with an electronic lock, said resistor is arranged on the electronic circuit which supports this lock.

Also by way of example, parameter X can be a vibration capable of propagating over a wall of the enclosure. For this purpose, transducer 35 includes an acceleration sensor such as that marketed under the reference ≪ADXLO5≫ by the Analog Device company. In the preferred case where the entry door is fitted with an electronic lock, said acceleration sensor is arranged on the electronic circuit which supports this lock.

Also by way of example, parameter X can be the presence of a foreign body possessing a physiological activity transmitting signals having a wavelength in the infrared range. For this purpose, transducer 35 includes a known presence detector, arranged to be able to detect, for example, the presence of a person enclosed in the enclosure, and to provide in response a logic signal to processing unit 37, this latter being able to alert a user outside the enclosure of such a presence.

With reference again to FIG. 3A, processing unit 37 is arranged to receive data relating to the measurement of parameter X, in particular measurement values X0 provided by transducer 35. For this purpose, locking system 31 also includes shaping means 39 connected to transducer 35, and an analogue-digital converter 41 connected to shaping means 39 and to processing unit 37.

Shaping means 39 are arranged so that they can receive measurement values X0 from transducer 35, and provide first data designated X1 derived from the measurement of parameter X, as is described hereinafter. For example, shaping means 39 include known programmable low-pass filters.

Analogue-digital converter 41 is arranged so that it can receive data X1 in analogue form, convert such data in digital form into second data designated X2, and provide data X2 to processing unit 37. Preferably, the analogue-digital converter integrated in the component ≪H83834≫ described hereinbefore is used as analogue-digital converter 41.

At the end of such shaping and conversion, measurement values X0 can be processed by processing unit 37. For this purpose, locking system 31 includes storage means 43 able to contain third data or reference data relating to parameter X, such data being pre-programmed during installation of the enclosure in a specific environment. In the following description, these reference data will be designated by the reference X3.

By way of example, these data constitute predetermined thresholds depending on the environment and/or the physical arrangement of the enclosure, and/or the daily activity in the environment. The predetermined thresholds can include minimum and/or maximum values of parameter X, and/or minimum and/or maximum values of the variation thereof over a predetermined period of time.

It will be noted that, within the scope of the present description, ≪daily activity≫ means a succession of first time periods during which the entry door can be unlocked or locked, via provision of access codes to locking system 31, and second time periods during which the entry door cannot be unlocked.

Storage means 43 are connected to processing unit 37, so that this unit can have access to data X3. Preferably, the EEPROM memory marketed under the name ≪X24325S≫ by the XICOR company is used as storage means 43.

Processing unit 37 can be arranged to compare the predetermined thresholds to data X2, so as to determine whether an anomalous development in parameter X is comprised in the range delimited by said minimum value and/or said maximum value. As a function of the result of this comparison, processing unit 37 can provide the locking or unlocking command or instruction to mechanism 33. In other words, processing unit 37 checks whether measurement values X0, after shaping and conversion, are comprised in a range in which the values of parameter X, or those of the variations thereof, are considered normal, i.e. occurring during normal activity in the environment of the enclosure.

Locking system 31 is particularly suited to the control of the temperature of the air present in the environment of the enclosure, as is illustrated in more detail hereinafter.

Figure 3A:
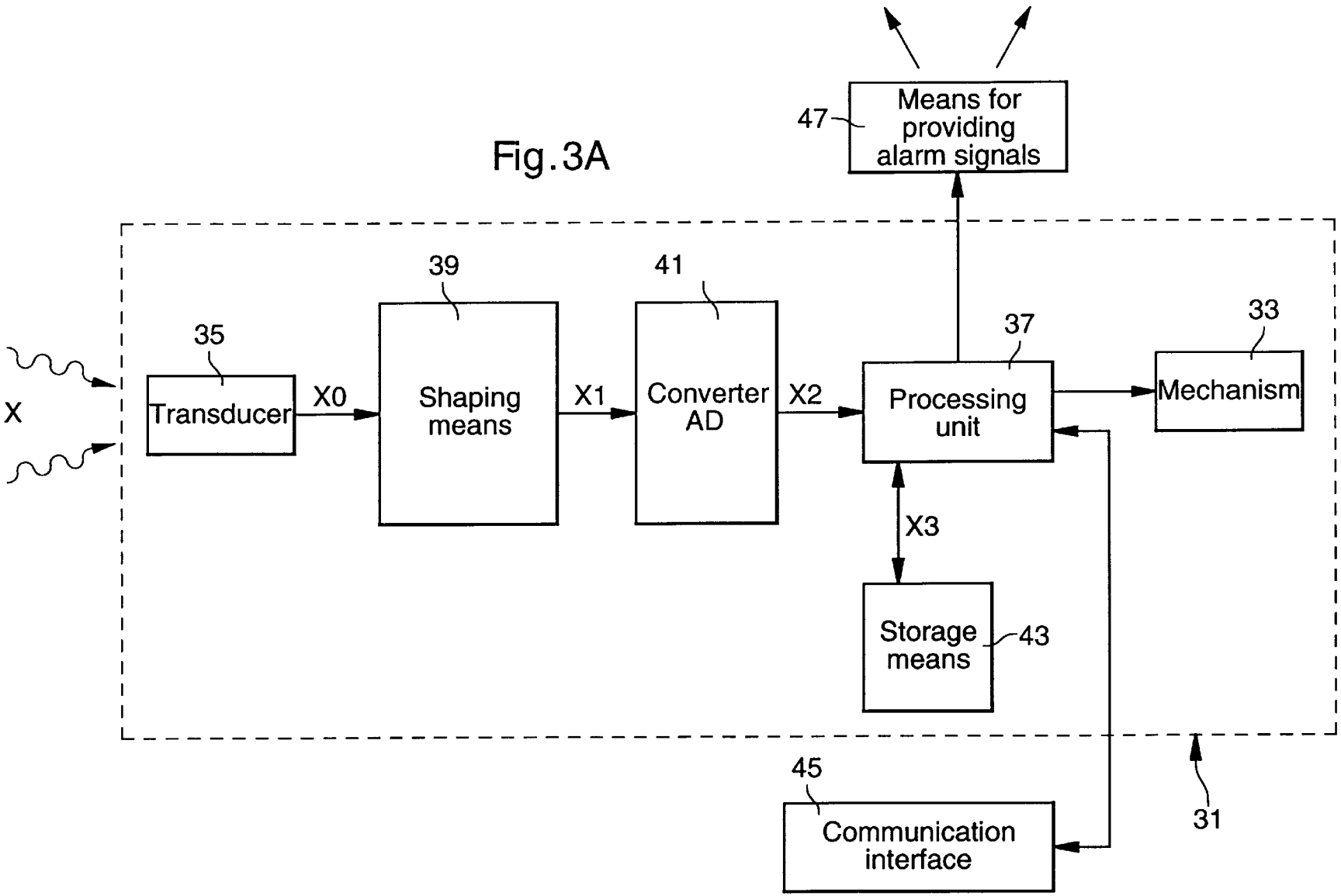
FIG. 3A shows a block diagram of a first embodiment of the locking system according to the present invention.

Those skilled in the art will note that locking system 31 preferably incorporates all the components connected to processing unit 37. Such incorporation is illustrated in FIG. 3A and the following figures by a dotted line. However, by way of alternative, it goes without saying that transducer 35 can be arranged in proximity to the locking system according to the invention, without being incorporated therein.

Figure 3B:
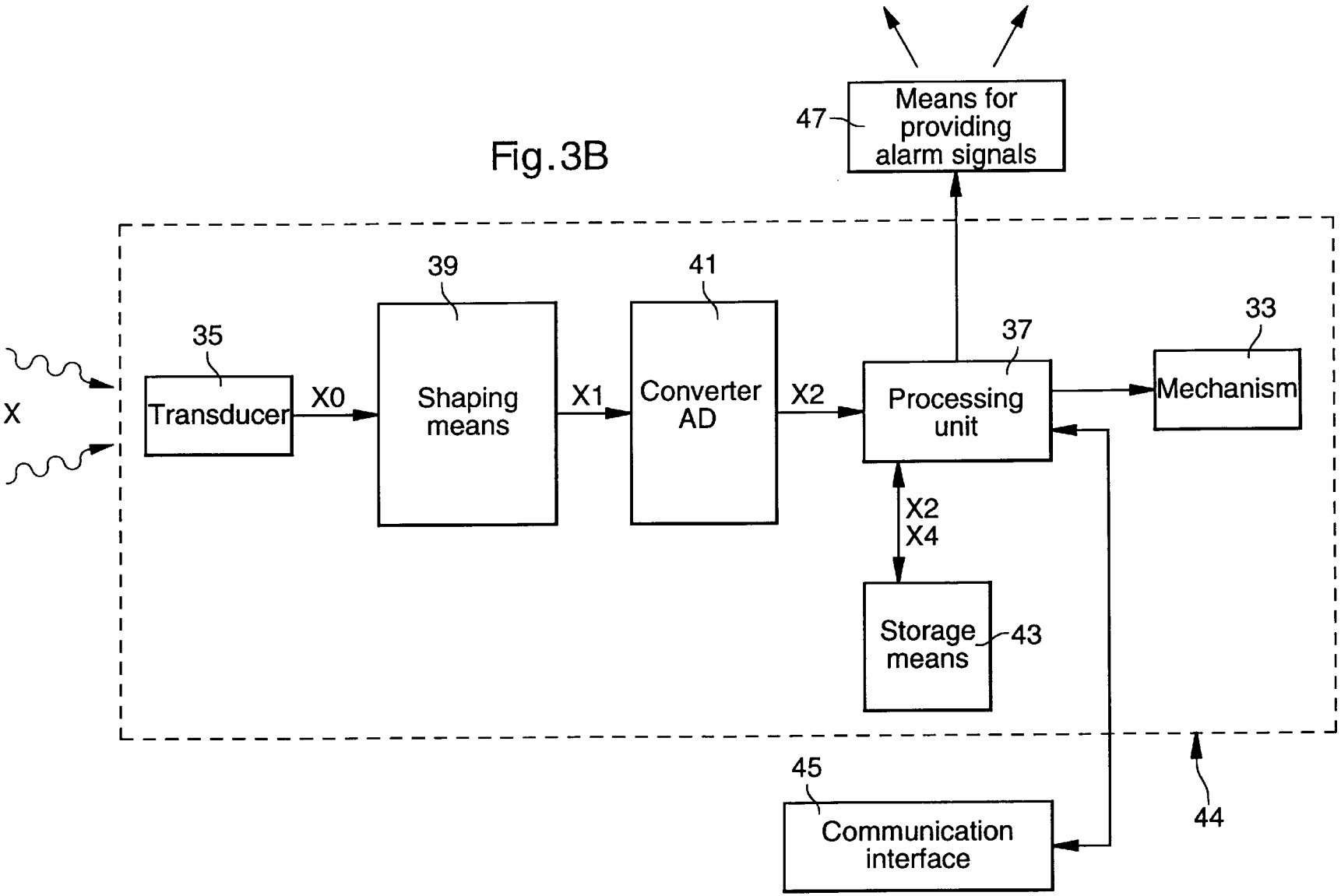
FIG. 3B shows a block diagram of a second embodiment of the locking system according to the present invention.

FIG. 3B shows a block diagram of a second embodiment of a locking system according to the present invention, designated by the reference 44. It will be noted that elements shown in FIG. 3B and designated by the same references as elements shown in FIG. 3A are substantially identical to those described in relation to FIG. 3A.

Moreover, storage means 43 of locking system 44 contain fourth data designated X4 including a plurality of predetermined data or signatures, each signature corresponding to data representing the effect on parameter X of a known phenomenon. In the present description, ≪phenomenon≫ is defined as a determined condition which is which triggers an anomalous development in parameter X, such condition being able to be of a deliberate nature (for example drilling through the entry door or a change in position of the bolt of the locking system following picking of such locking system) or unintentional (for example an industrial activity occurring in the proximity of the enclosure, or an atmospheric activity such as a variation in temperature).

For this purpose, signatures can be stored during installation of locking system 44, like data X3. By way of example, these signatures can include vibrations resulting from the operation of air-conditioning, or the use of a pneumatic hammer in proximity to the enclosure. Also by way of example, storage means 43 can contain as signatures data X2 derived from the measurement of parameter X.

Processing unit 37 of locking system 44 is also arranged so that it can perform, from among the signatures contained in storage means 43, identification of the signature which is substantially equal to data X2 originating from transducer 35. Typically, processing unit 37 checks whether the variation in measured parameter X over a predetermined period of time, after shaping and conversion, is substantially equal to one of the signatures known to locking system 44. As a function of the result of this identification, processing unit 37 provides an instruction to mechanism 33 capable of commanding locking and/or unlocking of the entry door. In other words, processing unit 37 can thus determine whether an anomalous development in measured parameter X is linked to a known phenomenon, i.e. if it is normal for this phenomenon to occur.

Locking system 44 is particularly suited to the control of the vibration capable of propagating over the walls of the enclosure, as is illustrated in more detail hereinafter.

By way of improvement, as shown in FIG. 3A or FIG. 3B, locking system 31 and locking system 44 can include a communication interface 45 connected to processing unit 37, this interface including data display means allowing, if necessary, display of the locking or unlocking instruction provided to mechanism 33, and/or display of measurement data X0. Communication interface 45 can also include data input means, so that processing unit 37 can establish unidirectional or bi-directional communication with a user outside the environment of the enclosure. Thus, processing unit 37 can transfer to such user the measured values of parameter X and, if necessary, the locking and/or unlocking command provided to mechanism 33. Likewise, the outside user can interrogate processing unit 37 from a distance to provide a new locking or unlocking instruction to validate or invalidate the instruction provided in response to measurement values X0. He can also modify data X3 contained in storage means 43.

This improved embodiment of locking system 31 and locking system 44 is particularly suited to the control of the presence of a person in the enclosure. Let us consider the case in which the enclosure is provided with a conventional presence detector. Let us suppose that, after the entry door is locked, a person is shut inside the enclosure. The arrangement described hereinbefore allows in such case the presence of this person to be detected, and allows a message to the outside user to be displayed in response, via communication interface 45. In such case, the user can decide from a distance to unlock (or lock) the entry door, to allow (or prevent) the release of the person shut inside the enclosure.

It will be noted that, once again, such an arrangement of the locking system according to the invention allows locking and/or unlocking of the entry door, as a function of the examination of the nature of the phenomenon which triggers the anomalous development in the measured parameter.

Also by way of improvement, as shown in FIG. 3A or 3B, locking system 31 and locking system 44 can also include means 47 for providing alarm signals. Typically, these means are arranged so that they provide alarm signals when they receive alarm control signals. Preferably, these means are formed of at least one known bistable relay, to which is connected, for example, a telephone transmitter, or an acoustic transmitter. Supply means 47 are connected to processing unit 37 so that this unit can provide alarm control signals, as a function of the results derived from said comparison and/or said identification of the data from transducer 35, this comparison and identification being performed by processing unit 37.

Purely by way of illustration, a first operating mode relating to locking system 31, i.e. to the monitoring of the ambient temperature, and a second operating mode relating to locking system 44, i.e. to the monitoring of the vibration propagating over one of the walls of the enclosure, will now be described.

With reference again to FIG. 3A, let us consider the first operating mode relating to the monitoring of the ambient temperature of the environment.

Typically, a programmer can input a temperature range or a temperature gradient range, into storage means 43, via communication interface 45 and processing unit 37. Such a range is defined by said minimum value and/or said maximum value, so that, when a development in the ambient temperature corresponds to values comprised within such range, this development is considered normal.

Figure 4A:
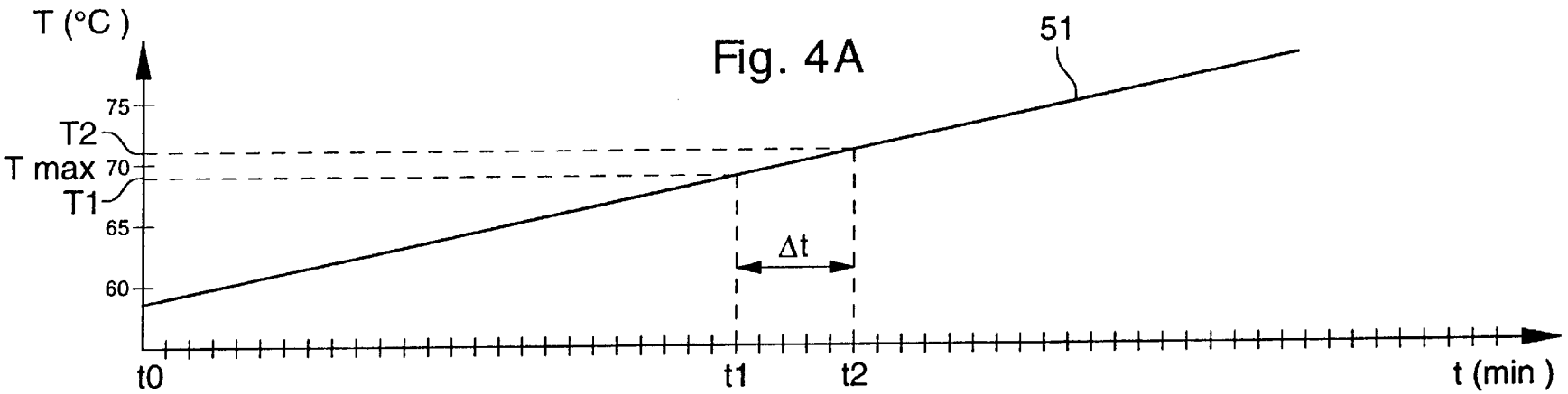
FIGS. 4A and 4B illustrate respectively first and second time developments in the ambient temperature linked to the environment of the locking system of FIG. 3.

By way of example, FIG. 4A shows an experimental curve 51 illustrating the development of the temperature T as a function of time designated t, temperature T being the ambient temperature linked to the environment of the enclosure. Transducer 35 permanently provides a value of temperature T to processing unit 37 which periodically analyses the values provided by transducer 35. Thus, at an instant t1, temperature T thus measured equals T1 then, at an instant t2, it equals T2, the time interval between instants t1 and t2 corresponding to a predetermined measuring period Δt.

In the example shown in FIG. 4, the reference Tmax designates the maximum value of temperature T, above which the latter is considered as reflecting an anomalous situation. Thus, temperature T measured at instant t1 is less than value Tmax, while temperature T measured at instant t2 is greater than such value. Consequently, processing unit 37 can command alarm means 47 to supply alarm signals, to indicate to a person concerned the existence of an anomalous situation in the environment of the enclosure, linked to an anomalous increase in the ambient temperature thereof.

Figure 4B:
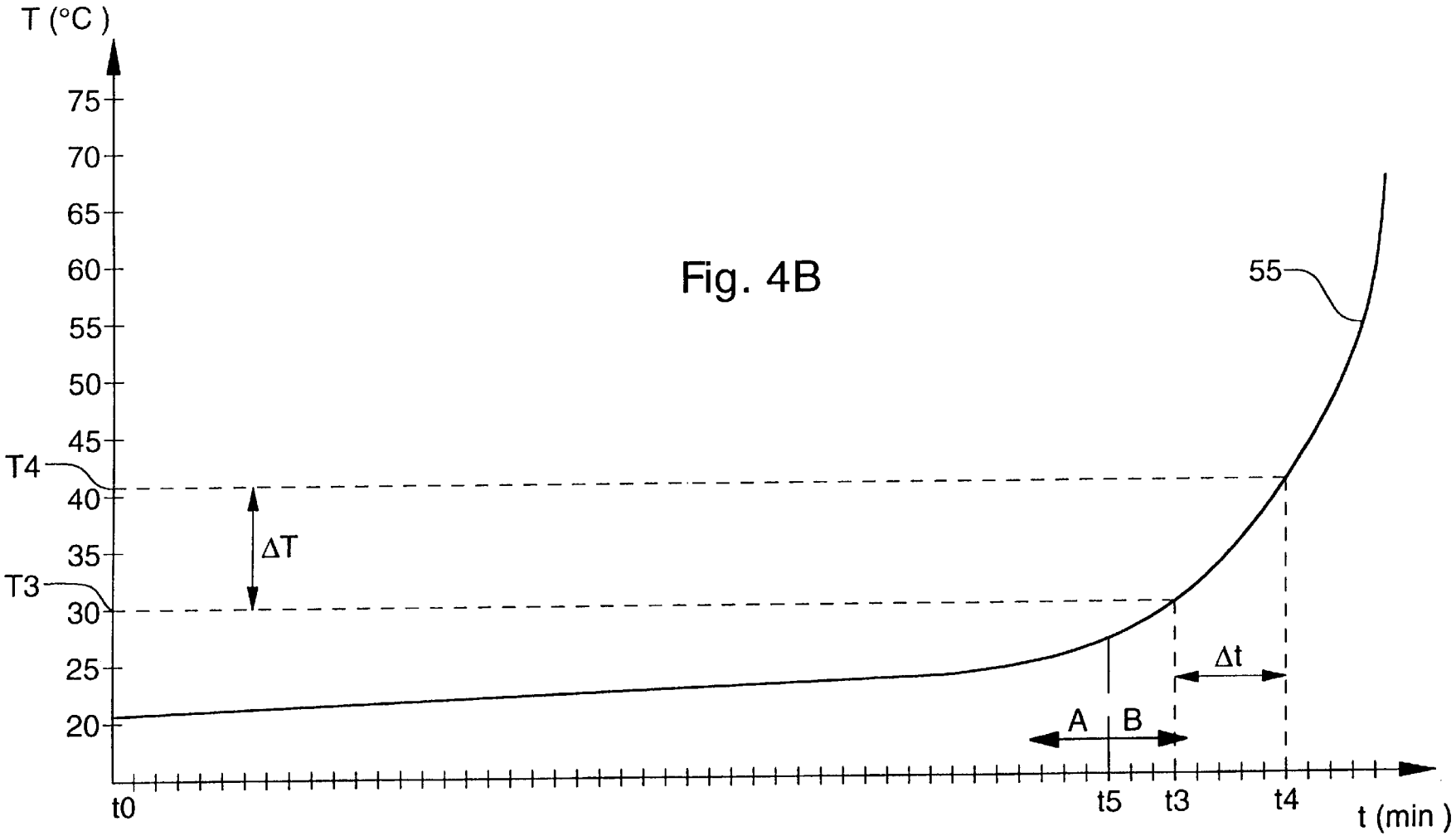

Also by way of example, FIG. 4B shows an experimental curve 55 illustrating the development of temperature T as a function of time designated t. Thus, in this example, at an instant t3, temperature T thus measured equals T3 then, at an instant t4, it equals T4, the time interval between instants t3 and t4 corresponding to a predetermined measuring period Δt.

In the example shown in FIG. 4B, the reference ΔT designates the difference in temperature between two consecutive measurements. Processing unit 37 determines the temperature gradient between instants t3 and t4, i.e. the ratio ΔT/Δt. FIG. 4B illustrates the case in which the temperature gradient is comprised within said range, this situation being represented during the period delimited by initial instant t0 and an instant t5 (see arrow A) . Let us suppose now that said gradient is outside said range. This situation is illustrated in FIG. 4B and, more particularly, in the period of time beginning at instant t5 (see arrow B). Consequently, processing unit 37 commands alarm means 47 to supply alarm signals, to indicate to a person concerned the existence of an anomalous situation in the environment of the enclosure, linked to an anomalous increase in the temperature gradient of ambient temperature T.

With reference again to FIG. 3B, let us consider the second operating mode relating to the control of the vibration, designated in the following description by the reference X0.

Typically, a programmer can input signatures into storage means 43, via communication interface 45 and processing unit 37.

Figure 5A:
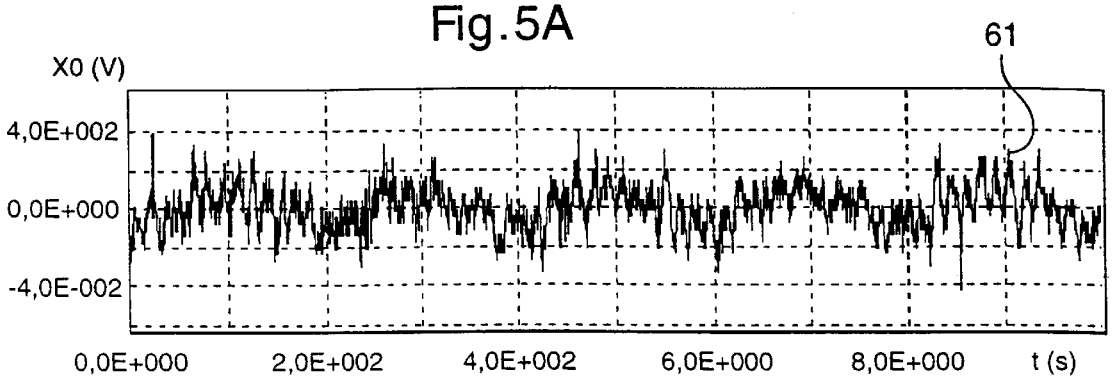
FIGS. 5A, 5C and 5E show experimental curves each illustrating a time sample of vibrations caused respectively by first, second and third phenomena detected by the locking system of FIG. 3B.

By way of example, the Applicant of the present invention has experimentally generated a first vibration using a vibrating electric drill applied onto one of the walls of the enclosure. FIG. 5A shows a curve 61 illustrating the development of the first vibration X0 measured as a function of time t.

Figure 5B:
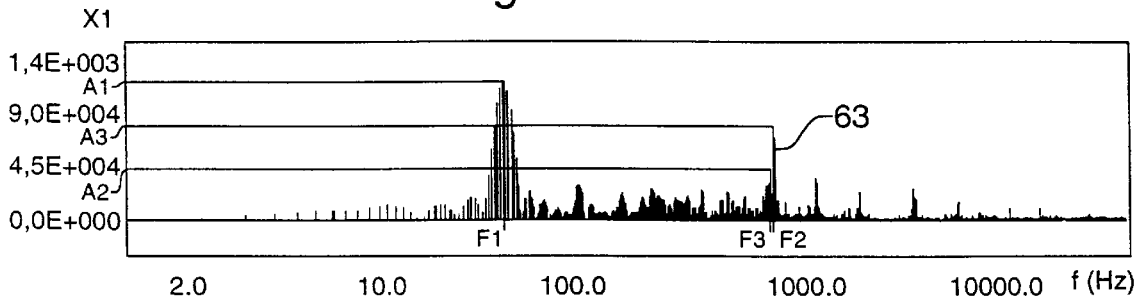
FIGS. 5B, 5D and 5F each show a spectral image of the samples shown respectively in FIGS. 5A, 5C and 5F.

Transducer 35 supplies a sample of the time development of first vibration X0. The sample of FIG. 5A corresponds to a time window of 100 ms. After shaping of this sample, processing unit 37 then determines the spectral image of this sample. FIG. 5B shows a curve 63 illustrating a spectral image of the sample shown in FIG. 5A. Then processing unit 37 analyses this image to extract therefrom three principle frequencies corresponding to three maximum amplitudes of said spectral image. References A1 to A3 designate the three principle amplitudes and references F1 to F3 designate the three corresponding frequencies. Table 1 shows the three principle amplitudes Ai and the associated frequencies Fi, derived from the results of experiments conducted by the Applicant of the present invention, in relation to FIGS. 5A and 5B.

TABLE 1

| i | 1 | 2 | 3 |
|---|---|---|---|
| Ai | 1.00 | 0.68 | 0.38 |
| Fi (Hz) | 51 | 680 | 650 |

Finally, processing unit 37 checks whether or not the three pairs (Fi, Ai) correspond to a known signature (i.e. to pairs previously input by the programmer, during installation of the system, or during its past experience).

Let us suppose that the three pairs (Fi, Ai) correspond to a known signature, processing unit 37 then does not command the supply of alarm signals.

Let us now suppose that the three pairs (Fi, Ai) do not correspond to any known signature, processing unit then commands in response the supply of alarm signals, via supply means 47. After having performed this type of detection of an anomalous development in vibration X0, the programmer or an authorised user must supply in response an instruction to locking system 44. This instruction allows validation to be provided as to whether processing unit 37 has to consider said development as the effect of a normal or anomalous situation, by inputting the three pairs (Fi, Ai) into storage means 43 as signatures.

Those skilled in the art will note that locking system 44 is thus provided with a storage or learning function allowing it to acquire data relevant to its experience, at the heart of a specific environment in which the locking system is arranged. This advantageously gives the locking system the faculty of ≪intelligent≫ interpretation of the events which disturb it in the course of its daily operation.

Moreover, the Applicant of the present invention has experimentally generated a second vibration X0 using the same vibrating drill as that used in relation to FIGS. 5A and 5B, but applied at a different location. For the sake of simplicity, the references used to describe the first vibration X0 will also be used to described the second vibration X0.

Figure 5C:
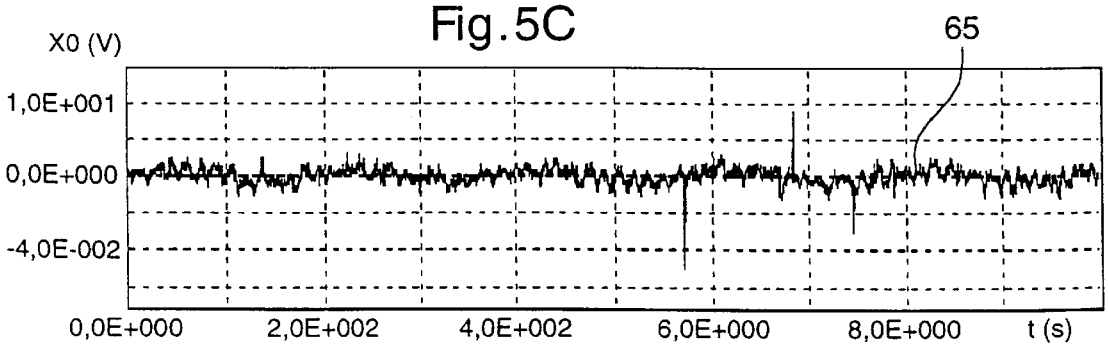
Figure 5D:
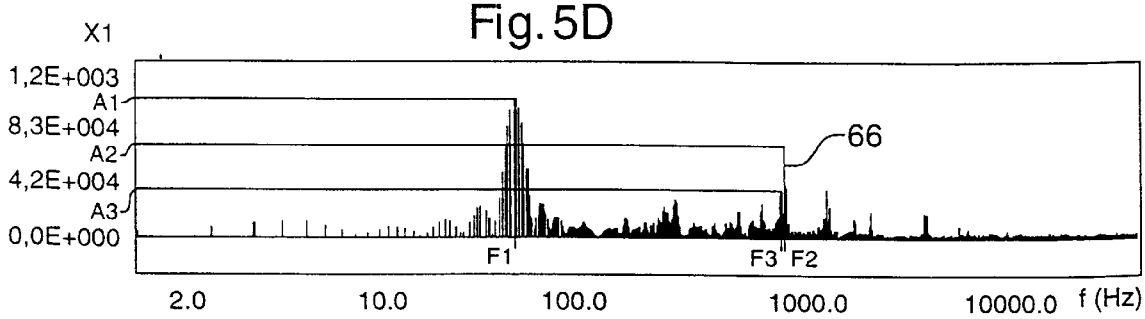

FIGS. 5C and 5D show the results of experiments linked to the second vibration X0, and table 2 shows the three principle amplitudes Ai and the associated frequencies Fi, linked to the second vibration X0.

TABLE 2

| i | 1 | 2 | 3 |
|---|---|---|---|
| Ai | 1.00 | 0.67 | 0.35 |
| Fi (Hz) | 52 | 680 | 650 |

It will be noted that the time sample of the second vibration X0 has a different wave shape 65 to that of the sample shown in FIG. 5A (i.e. curve 61). However, as FIG. 5D shows, the spectral image of the second vibration X0 has an identical wave shape 66 to that shown in FIG. 5B.

In other words, the first and second vibrations X0 generated by the Applicant of the present invention supply different time samples (shown in FIGS. 5A and 5C, respectively) which have two identical spectral image (shown in FIGS. 5B and 5D, respectively). In other words, the first and second vibrations X0 originate from the same phenomenon (the application of an electric drill onto a wall of the enclosure), this phenomenon being associated with a specific signature corresponding to the spectral images of FIGS. 5B and 5D.

Moreover, the Applicant of the present invention has experimentally generated a third vibration X0 using a grinding machine applied onto said wall. For the sake of simplicity, the references used to describe the first and second vibrations X0 will also be used to describe the third vibration X0.

Figure 5E:
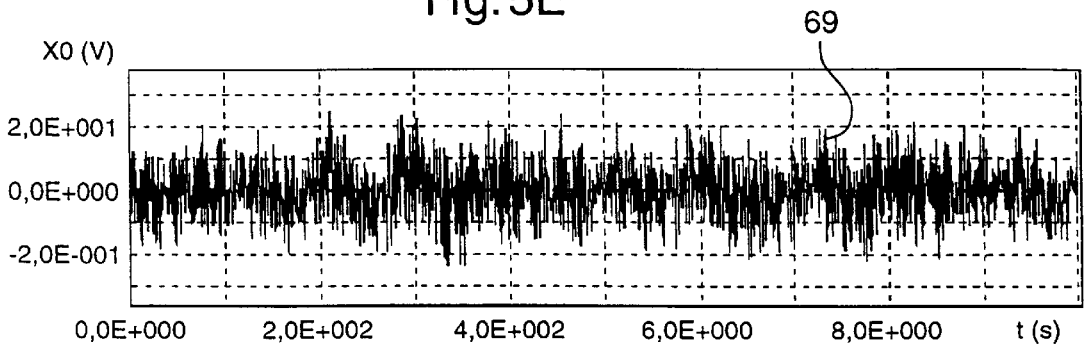
Figure 5F:
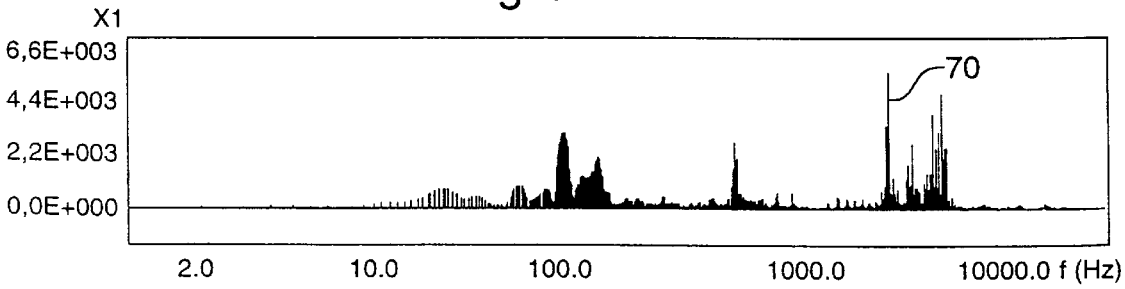

FIGS. 5E and 5F show the results of experiments linked to the third vibration X0.

It will be noted in FIG. 5E that the time sample of the third vibration X0 has a wave shape 69 which is substantially different to that of the samples shown in FIGS. 5A and 5C (i.e. respectively curves 61 and 65). And, as FIG. 5F shows, the third vibration X0 has a spectral image which has a substantially different wave shape 70 to that shown in FIG. 5B (i.e. curve 63). In other words, the third vibration X0 is associated with a different signature to that associated with the first and second vibrations X0, which confirms the existence of a signature particular to the grinding machine, and a signature particular to the electric drill. Consequently, processing unit 37 commands in response the supply of alarm signals, via supply means 47.

It goes without saying for those skilled in the art that the detailed description hereinbefore can undergo various modifications without departing from the scope of the present invention. By way of alternative, one can provide a locking system according to the present invention able to control the development of an acoustic signal close to the enclosure, or that of the molar fraction of a gas present in the environment of this enclosure. Also by way of alternative, one can provide control of the development of several parameters linked to the environment of the enclosure fitted with a locking system according to the present invention, by connecting appropriate transducers in parallel on said processing unit of the locking system.

What is claimed is:

1. A locking system intended to be fitted to an entry door to a security enclosure arranged in an environment, said locking system including:

a mechanism able to command, in response to an instruction, the locking and/or unlocking of said entry door;

storage means able to contain one or more predetermined thresholds relating to a parameter linked to said environment, said predetermined threshold(s) depending on said environment and/or the physical arrangement of said enclosure and/or the daily activity in said environment; and a processing unit able to: have access to said predetermined threshold(s); receive parameter measurement data originating from a transducer; process said measurement data so as to compare the processed measurement data to said predetermined threshold(s); determine whether a development in said parameter over a predetermined period of time is comprised within the range delimited by said threshold(s); and supply said command instruction to said mechanism as a function of the result of this determination.

2. A locking system according to claim 1, wherein said predetermined thresholds comprise minimum and/or maximum values of said parameter, or minimum and/or maximum values of the variation in said parameter during said predetermined period of time.

3. A locking system intended to be fitted to an entry door to a security enclosure arranged in an environment, said locking system including:

a mechanism able to command, in response to an instruction, the locking and/or unlocking of said entry door;

storage means able to contain a plurality of signatures, each signature corresponding to fourth predetermined data representing the effect on a parameter of a predetermined phenomenon occurring in environment; and a processing unit arranged to: have access to said signatures; receive parameter measurement data originating from a transducer; process said measurement data so as to be able to compare the processed measurement data to said signatures; determine whether said processed measurement data are substantially equal to one of said signatures, whether said development in said parameter is linked to a known phenomenon; and supply, as a function of the result of said determination, said command instruction to said mechanism.

4. A locking system according to claim 3, wherein said storage means also contain processed measurement data these latter being able to be used as signatures.

5. A locking system according to claim 1 or 3, wherein said storage means can receive and contain data originating from said processing unit in particular said measurement data or said processed measurement data so as to create a diary of events retracing the history of the locking system.

6. A locking system according to claim 1 or 3, incorporating said mechanism, said transducer, said processing unit and said storage means.

7. A locking system according to claim 1 or 3, further including a communication interface connected to said processing unit, said interface including data display means allowing display of said command instruction supplied to the mechanism, or display of said measurement data.

8. A locking system according to claim 7, wherein said communication interface further includes data input means, so that a user outside said environment can: supply a new command instruction to validate or invalidate the instruction supplied in response to said measurement data or receive from said processing unit data relating to the state of an additional parameter.

9. A locking system according to claim 1 or 3, also including means for supplying alarm signals connected to said processing unit, so that said unit can supply alarm command signals, as a function of the result of said determination.

10. A locking system according to claim 1 or 3, wherein said parameter is the ambient temperature of the environment of said enclosure.

11. A locking system according to claim 1 or 3, wherein said parameter is a vibration propagating over a wall of said enclosure.

12. A locking system according to claim 1 or 3, wherein said parameter is the molar fraction of a gas present in the environment of said enclosure.

13. A locking system according to claim 1 or 3, wherein said parameter is an acoustic signal present in the environment of said enclosure.

14. A locking system according to claim 1 or 3, wherein said parameter is a signal belonging to the presence of a foreign body having a physiological activity able to transmit such a signal.

15. Security enclosure fitted with a locking system according to any of claims 1 or 3.

* * * * *